US007285056B1

(12) United States Patent
Whitt

(10) Patent No.: US 7,285,056 B1
(45) Date of Patent: Oct. 23, 2007

(54) APPARATUS AND METHOD FOR TRAINING A GOLFER

(76) Inventor: Ricky L Whitt, 1215 Merlot Dr., Palm Beach Gardens, FL (US) 33410

( * ) Notice: Subject to any disclaimer, the term of this patent is extended or adjusted under 35 U.S.C. 154(b) by 0 days.

(21) Appl. No.: 11/633,126

(22) Filed: Dec. 4, 2006

(51) Int. Cl.
*A63B 69/36* (2006.01)

(52) U.S. Cl. ..... 473/277; 473/266

(58) Field of Classification Search ..... 473/266, 473/269–277, 207, 215
See application file for complete search history.

(56) References Cited

U.S. PATENT DOCUMENTS 3,215,438 A * 11/1965 Sheldon et al. ..... 473/277
4,366,981 A 1/1983 Ziegler et al.
4,433,870 A 2/1984 Bairen et al.
4,641,882 A 2/1987 Young
5,125,663 A * 6/1992 Lurowist, Jr. ..... 473/216
5,673,966 A 10/1997 Morton
6,062,638 A 5/2000 Ferguson
7,066,828 B2 * 6/2006 Lee et al. ..... 473/277

* cited by examiner

*Primary Examiner*—Nini F. Legesse
(74) *Attorney, Agent, or Firm*—David E Herron, II

(57) ABSTRACT

The disclosure sets forth an apparatus and method that is best used to train a player to swing a golf club. Specifically, the invention focuses upon how to train a golfer to assume a correct stance and posture from the point of addressing the ball through the swing and follow-through.

8 Claims, 6 Drawing Sheets

APPARATUS AND METHOD FOR TRAINING A GOLFER

SUMMARY OF THE INVENTION

The invention is an apparatus and method that is best used to train a player to swing a golf club, and specifically, how to train a golfer to assume a correct stance and posture from the point of addressing the ball through the swing and follow-through.

The Inventive Apparatus

The inventive apparatus forms a stool-like structure that has a lower portion having a ground engaging end. The apparatus also includes an upper portion coupled to the lower portion in such a way as to be selectively positionable to a preselected angle with respect to the lower portion. A cross member is coupled adjacent a top of the upper portion.

The lower portion will have a plurality of supports; each support is selectively positionable between a stowed position whereby the supports are generally parallel the lower portion, and an open position wherein the supports are generally orthogonal the lower portion; wherein, the player leans at least a portion of his weight against the cross member when swinging the golf club. In an optional embodiment, the apparatus will have a means for stopping the supports in the open position.

Optionally, the structure will have a collar positioned adjacent the ground engaging end of the lower portion. The collar is configured to slide along the lower portion, and each support is rotatably attached to it. In this embodiment, the apparatus will include a respective strut rotatably affixed to the lower portion at a first end, and rotatably attached to a respective support at a second end of the respective strut. Consequently, as the supports are moved from the open to the stowed position, the collar slides upwardly along the lower portion.

The cross member is preferably selectively positionable at a chosen angle with respect to the upper portion. Additionally, the upper portion is coupled to the lower portion by an upper eyelet on the lower portion formed to mate with a lower eyelet on the upper portion; wherein, the upper portion and lower portion are retained at the preselected angle by a bolt and nut that pass through the respective eyelets.

The Inventive Method

The invention is also a method of training a player to swing a golf club, and specifically, a method of training a golfer to assume the right stance and posture from the point of addressing the ball through the follow-through of the swing.

The inventive method includes the step of providing an apparatus having a lower portion with a ground engaging end, and an upper portion connected to the lower portion, and a cross member adjacent the top of the upper portion. A connector links the lower portion to the upper portion in such a manner as to enable selective positioning of the upper portion with respect to the lower portion.

The inventive method also requires the apparatus to include a plurality of supports on the lower portion. Each of these supports is selectively positionable between a stowed position (the supports generally parallel the lower portion) and an open position (the supports generally orthogonal the lower portion).

The inventive method will also require the player to address a golf ball lying on the ground with the golf club in hand, and assume a stance for a golf swing. At least a portion of the ground-engaging end is inserted into the ground, and the cross member is positioned to engage a rear-facing portion of the player. Additionally, the inventive method will include the step of leaning at least a portion of the player's weight against the cross member, and executing a golf swing. From address to follow-through, the cross member should remain in contact with the player.

A preferred embodiment of the method requires the apparatus to have a means for stopping the supports in the open position. Optionally, the means for stopping the supports may include a collar positioned adjacent the ground engaging end of the lower portion, and configured to slide along the lower portion, with each support being rotatably attached to the collar. In this optional version of the method, the stopping means will have a plurality of struts, each respective strut rotatably affixed to the lower portion at a first end, and rotatably attached to a respective support at a second end of the respective strut. Consequently, as the supports are moved from the open to the stowed position, the collar slides upwardly along the lower portion.

Preferably, the method will also include the step of inserting at least a portion of the ground-engaging end into ground, and will also allow one to selectively position the upper portion at a chosen angle with respect to the lower portion.

In another preferred embodiment, the method will include the steps of providing eyelets on the upper and lower portions of the apparatus, positioning the upper portion at a chosen angle with respect to the lower portion, then tightening the connector to maintain the chosen angle. Moreover, the inventive method may also allow the cross member to be rotatably adjustable relative the upper portion such that the cross member is rotatably connectable to the upper portion. In this embodiment, the method will include the step of positioning the cross member at a preselected angle with respect to the upper portion, and, maintaining—preferably by tightening a connector to restrict relative movement—the preselected angle.

Other objects, advantages and novel features of the invention will become apparent from the following detailed description of the invention when considered in conjunction with the accompanying drawings.

DETAILED DESCRIPTION OF THE PREFERRED EMBODIMENTS

Figure 1:
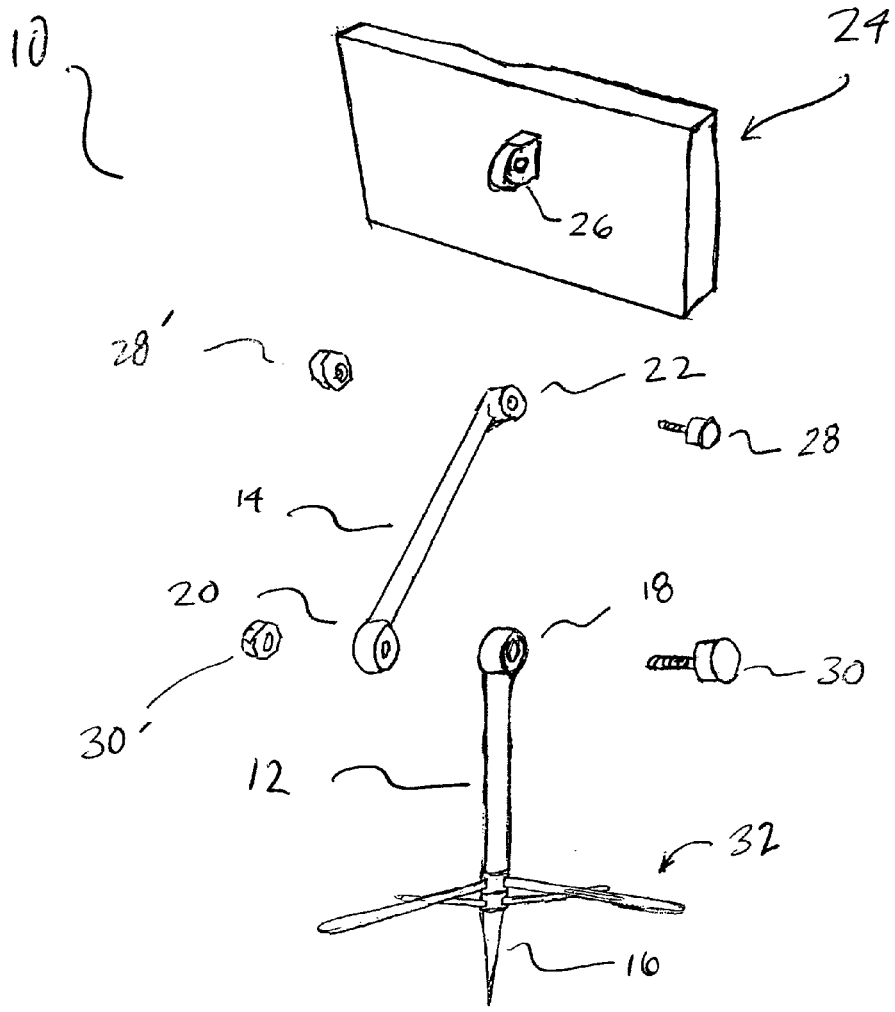
FIG. 1 is a perspective and exploded view showing the inventive apparatus, according to the principles of the invention.

FIG. 1 is an exploded and perspective view detailing the inventive apparatus 10, which comprises a lower portion 12, an upper portion 14, and a cross-member 24. The lower portion 12 has a ground engaging end 16 with a supporting means 32 for holding the apparatus 10 in generally stable upright position.

As shown in FIG. 1, an upper eyelet is at the top of the lower portion, and is formed to mate with a lower eyelet 20 formed at an end of the upper portion. In a preferred embodiment such as the embodiment depicted in FIG. 1, a connector (such as a knob 30 and nut 30') pass through the eyelets 18, 20 to link the upper portion 14 to the lower portion 12. The connector may comprise any known linking means that enables selective positioning of the upper portion 14 with respect to the lower portion 12, and can hold and maintain the selected position.

As shown in FIG. 1, the cross member 24 may have an ear-like eyelet 26 formed on its rear face; this eyelet 26 on the cross member 24 is formed to mate with an upper eyelet 22 formed on the upper portion 14 of the apparatus 10. The apparatus 10 will also include a connector (such as a knob 28 and a nut 28') formed to pass through the eyelets to link the cross member 24 to the top portion 14. Of course, the connector may comprise any known linking means that would enable selective positioning of the cross member 24 with respect to the upper portion 14.

The ground engaging end 16 of the lower portion 12 bears a taper in order to facilitate the insertion of at least a portion of the ground engaging end into the ground. A stabilizing means 32 is positioned adjacent the ground-engaging end 16 of the lower portion.

Figure 2:
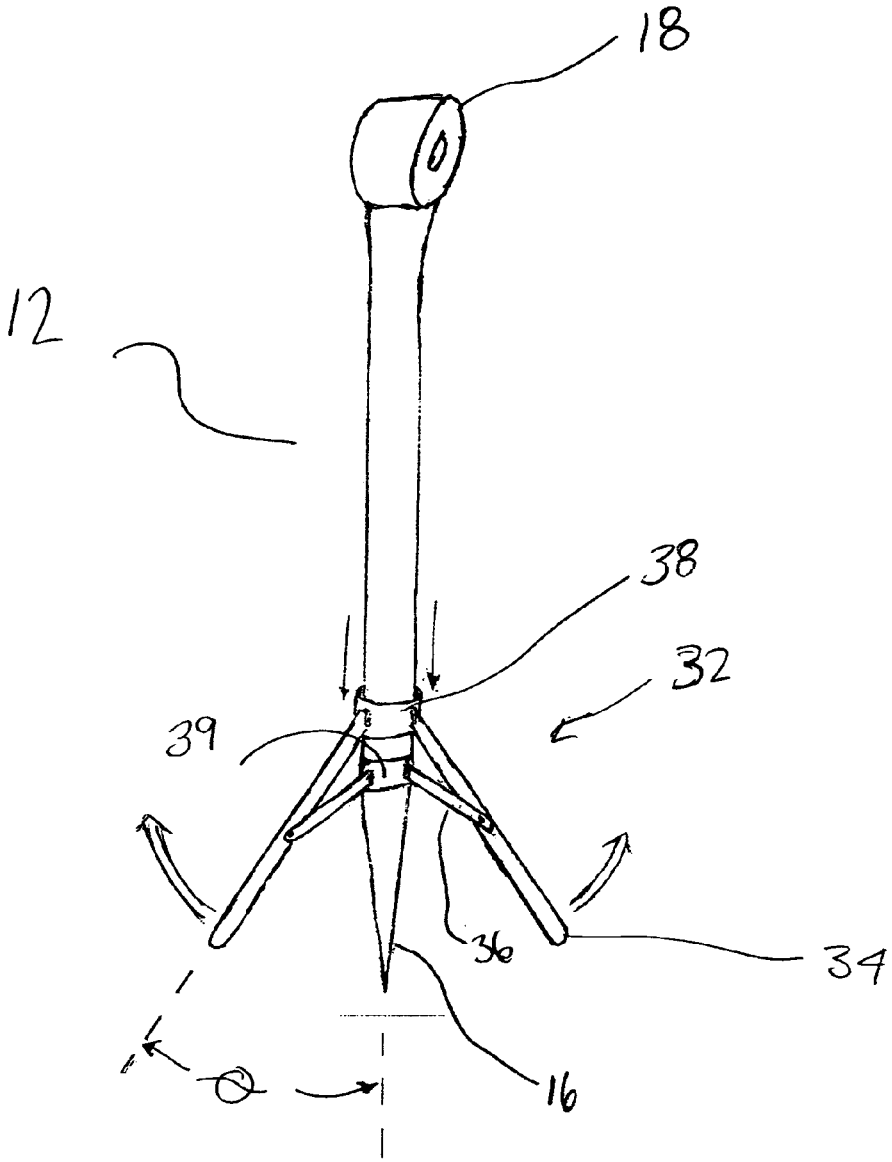
FIGS. 2-4 are comparative perspective views isolating the lower portion of the inventive apparatus.

FIG. 2 is a perspective view that isolates the lower portion and gives greater detail of the stabilizing means 32 that is adjacent the ground engaging end 16 of the lower portion 12. The stabilizing means 32 includes a collar 38 configured to slide along the lower portion 12. A plurality of supports 34 are rotatably coupled to the collar 38 so that the supports 34 form an angle Θ) with respect to the longitudinal axis of the lower portion 12.

Still referring to FIG. 2, the stabilizing means 32 includes a plurality of struts 36 attached to a lower collar 39 that is affixed to the lower portion 12 at a position adjacent the tapered ground-engaging end 16. Each respective support 34 will have a respective strut 36 that is rotatably connected to the lower collar 39 at a first end, and rotatably connected to a respective support its second end of the strut 36. Consequently, as the supports 34 are opened (i.e., angle Θ is increased), the upper collar 38 slides downwardly in the direction shown toward the lower collar 39.

Figure 3:
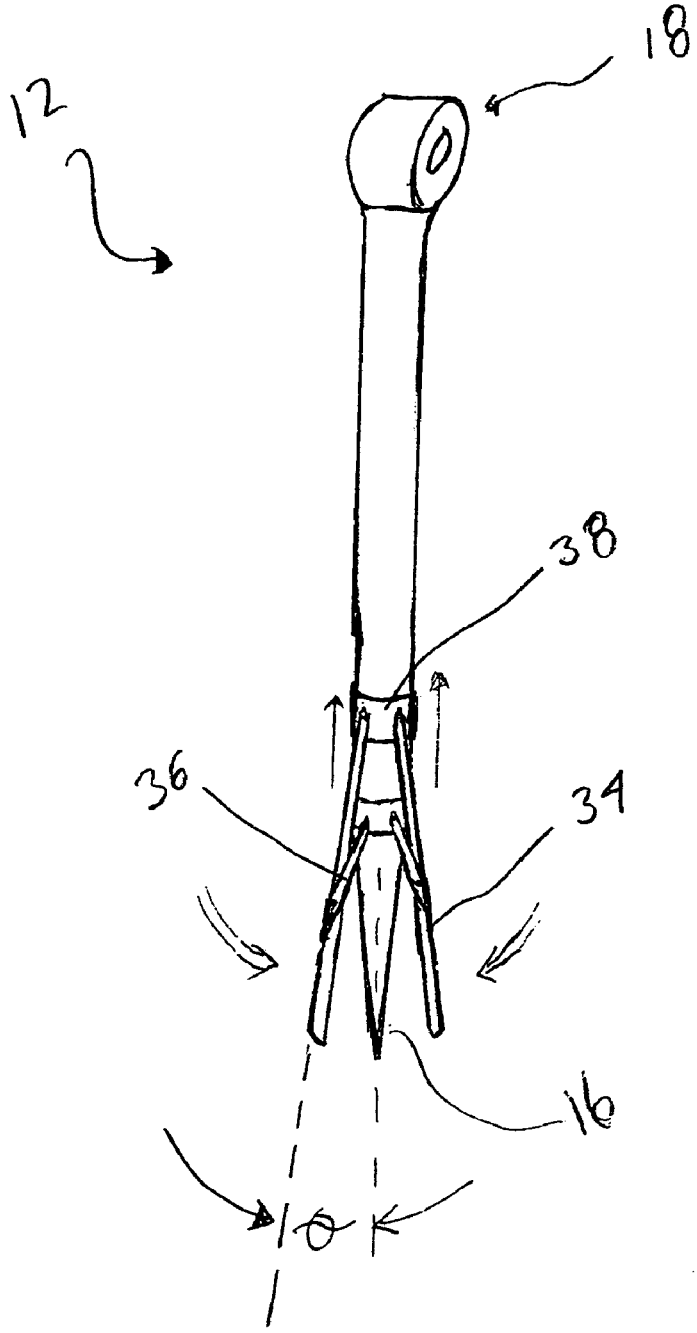

FIG. 3 shows an isolated and perspective view of the lower portion 12, shown with the stabilizing means 32 in a stowed position whereby angle Θ) is minimized, and the supports 34 are nearly parallel the lower portion 12. As the angle Θ is reduced (i.e., the supports 34 pushed inwardly in the direction shown), the supports 34 move the upper collar 38 upwardly along the lower portion 12. The lower collar 39, of course, remains anchored and affixed adjacent the tapered ground-engaging end 15 of the lower portion.

Figure 4:
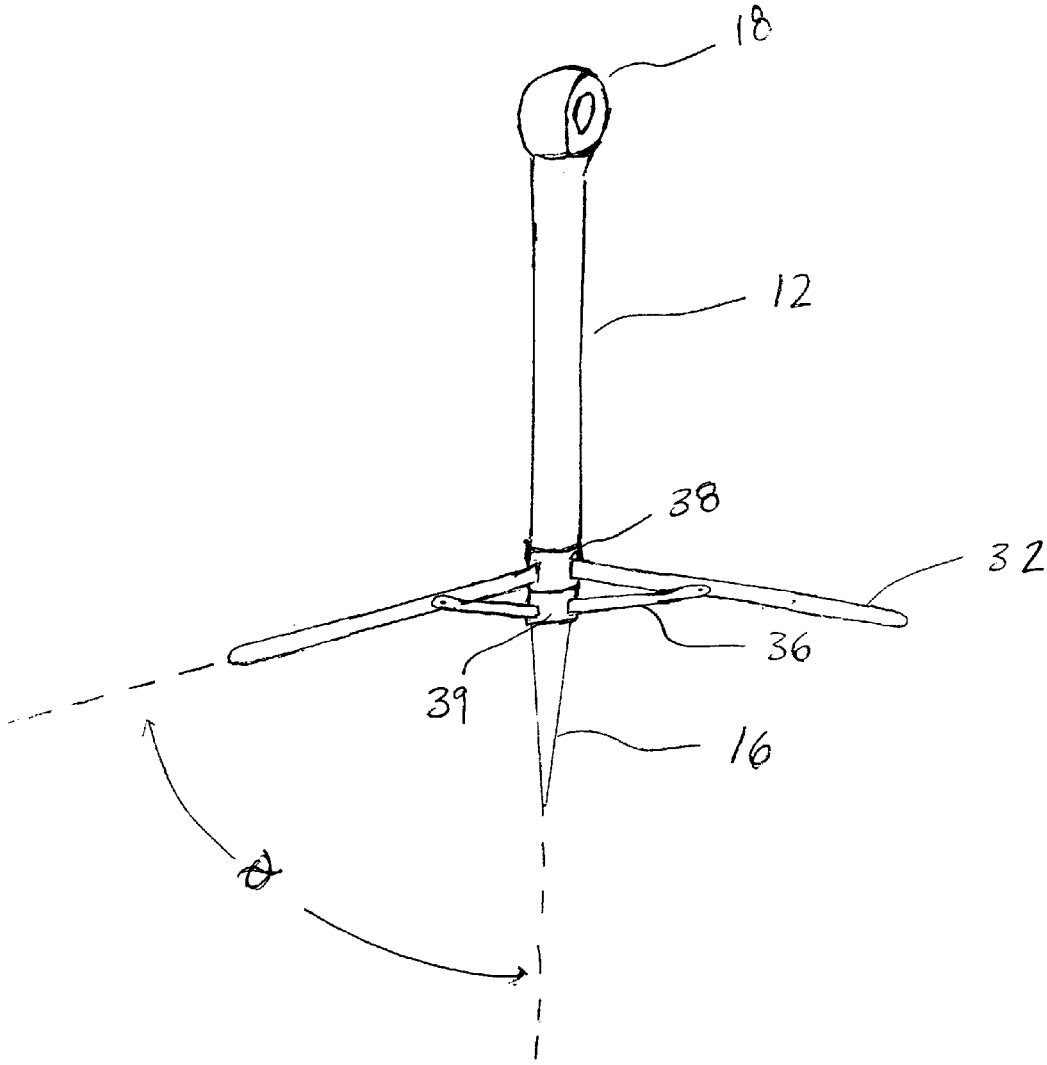

FIG. 4 shows an isolated and perspective view of the lower portion 12, shown in this comparative view with the stabilizing means 32 in its fully-open position so that the angle Θ is maximized and nearly a right angle. As the supports 34 are opened (i.e., angle Θ is increased), the upper collar 38 slides downwardly along the lower portion 12. When the angle Θ is maximized, the upper collar 38 abuts the lower collar 39 as shown, which gives a locking effect that prevents the supports 34 from opening any further so that the stabilizing means can provide support to the apparatus 10 (shown in FIG. 1) when the tapered ground-engaging end 16 is inserted into the ground.

Figure 5:
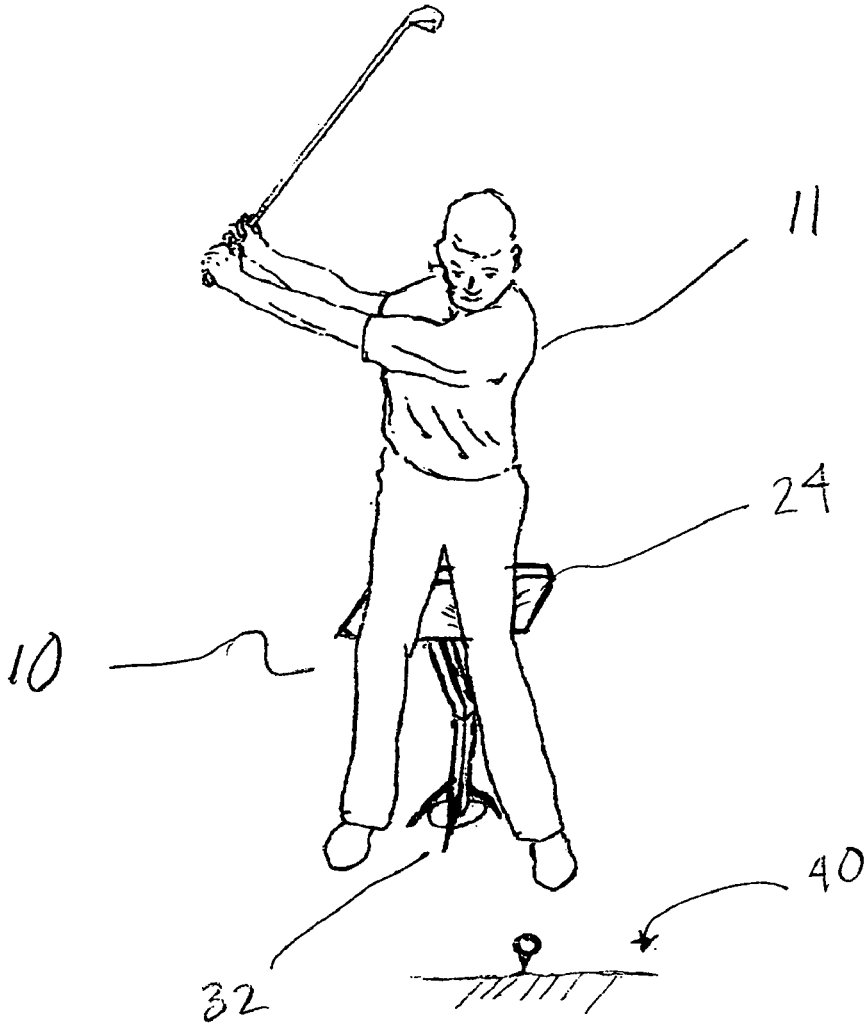
FIGS. 5 and 6 are perspective views showing the inventive method of teaching a golf swing.

FIG. 5 shows a golfer 11 assuming a stance for a golf swing after addressing a golf ball positioned on the ground 40. The golfer 11 first unfolds and opens the stabilizing means 32 (as shown in prior FIGS. 2-4) then inserts the tapered ground-engaging end 16 (not shown in FIG. 5 but viewable in FIGS. 1-4) into the ground 40. The golfer 11 then addresses the golf ball and assumes a stance such that at least a portion of the golfer's weight engages the cross member 24 of the apparatus. It is important to note that the golfer 11 should lean slightly—not heavily—against the apparatus. In the preferred embodiment of the method, the apparatus 10 is not intended to be used as a stool-like structure; rather, the preferred embodiment of the method requires the golfer 11 to ever-so-slightly engage the cross member 24. While the placement and positioning of the cross member 24 may be adjusted, it is preferred that the cross member contact the golfer 11 at approximately the golfer's hamstrings or glutes.

Figure 6:
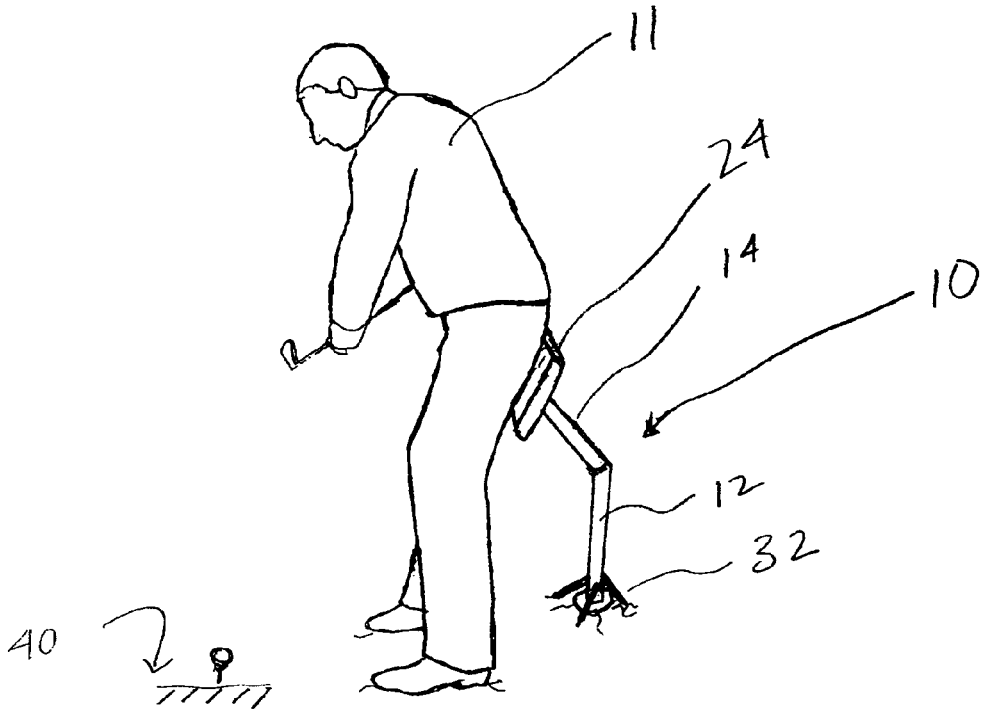

FIG. 6 shows a perspective, side view of a golfer 11 swinging at a golf ball on the ground 40. As shown, the stabilizing means 32 is opened so that it holds the lower portion 12 of the apparatus 10 in a generally vertical position when the tapered ground-engaging end 16 (not shown in FIG. 6, but viewable in FIGS. 1-4) is inserted into the ground 40. The upper portion 14 is linked to the lower portion 12 and held at a preselected angle by connectors (See FIG. 1) that anchor and stabilize the two portions 12, 14.

As shown in FIG. 6, the cross-member of the apparatus 10 engages the golfer 11 at approximately the buttocks or hamstrings; the precise location of the contact is not critical, however, it is important to note that only a slight portion of the weight of the golfer 11 engages against the cross member 24. In fact, it is preferred that the golfer 11 initiate and maintain on slight contact with the cross member 24 throughout the golf swing, from address to backswing, to the follow through.

Although the present invention has been described and illustrated in detail, it is to be clearly understood that the same is by way of illustration and example only, and is not to be taken by way of limitation. The spirit and scope of the present invention are to be limited only by the terms of the appended claims.

The invention claimed is:

1. A method of training a player to swing a golf club comprising the steps of:

providing an apparatus having a lower portion having a ground engaging end;

an upper portion having a cross member positioned adjacent its top;

a connector linking the lower portion to the upper portion and enabling selective positioning of the upper portion with respect to the lower portion;

a plurality of supports positioned on the lower portion, each support being selectively positionable between a stowed position whereby the supports are generally parallel the lower portion, and an open position wherein the supports are generally orthogonal the lower portion; and, addressing a golf ball lying on the ground with the golf club in hand;

assuming a stance for a golf swing;

inserting at least a portion of the ground-engaging end into the ground;

positioning the cross member to engage a rear-facing portion of the player;

leaning at least a portion of the player's weight against the cross member;

executing a golf swing; wherein, the cross member remains in contact with the player through the swing.

2. The method as in claim 1, the apparatus further including a mean for stopping the supports in the open position.

3. The method as in claim 2, the stopping means comprising a collar positioned adjacent the ground engaging end of the lower portion, and configured to slide along the lower portion, each said support being rotatably attached to the collar;

a plurality of struts, each respective strut rotatably affixed to the lower portion at a first end, and rotatably attached to a respective support at a second end of the respective strut; wherein, as the supports are moved from the open to the stowed position, the collar slides upwardly along the lower portion.

4. The method as in claim 1, further comprising the step of selectively positioning the upper portion at a chosen angle with respect to the lower portion.

5. The method as in claim 4, further including the steps of providing an upper eyelet on the lower portion;

providing a lower eyelet on the upper portion; and, passing a connector through each of the upper and lower eyelets;

positioning the upper portion at a chosen angle with respect to the lower portion;

tightening the connector to maintain the chosen angle.

6. The method as in claim 1, further including the steps of rotatably connecting the cross member to the upper portion; and, positioning the cross member at a preselected angle with respect to the upper portion; and, maintaining the preselected angle.

7. The method as in claim 6, wherein the maintaining step includes the step of tightening a connector to restrict relative movement of the cross member with respect to the upper portion.

8. The method as in claim 1, further including the step of inserting at least a portion of the ground engaging end into the ground.

* * * * *